US005908287A

United States Patent [19]

Kim et al.

[11] Patent Number: 5,908,287

[45] Date of Patent: Jun. 1, 1999

[54] SUCTION NOISE MUFFLER MOUNTING APPARATUS FOR HERMETIC COMPRESSOR

[75] Inventors: Tae Min Kim; Jae Seok Oh, both of Changwon, Rep. of Korea

[73] Assignee: LG Electronics Inc., Rep. of Korea

[21] Appl. No.: 08/880,089

[22] Filed: Jun. 20, 1997

Related U.S. Application Data

[62] Division of application No. 08/740,525, Nov. 4, 1996, Pat. No. 5,707,216.

[30] Foreign Application Priority Data

Nov. 15, 1995 [KR] Rep. of Korea ..... 95/41504

[51] Int. Cl.[6] ..... F04B 39/06; F04B 53/08

[52] U.S. Cl. ..... 417/312; 417/902; 181/229

[58] Field of Search ..... 417/312, 902; 181/229, 403

[56] References Cited

U.S. PATENT DOCUMENTS

| | | | |
|---|---|---|---|
| 4,415,060 | 11/1983 | Bar | 181/272 |
| 4,449,610 | 5/1984 | Bar | 181/243 |
| 4,784,581 | 11/1988 | Fritchmann | 417/312 |
| 5,201,640 | 4/1993 | Heinzelmann et al. | 417/312 |
| 5,207,564 | 5/1993 | Fritchmann | 417/312 |
| 5,304,044 | 4/1994 | Wada et al. | 417/312 |
| 5,496,156 | 3/1996 | Harper et al. | 417/312 |
| 5,577,898 | 11/1996 | Lee | 417/312 |
| 5,613,842 | 3/1997 | Alfano et al. | 417/312 |
| 5,641,949 | 6/1997 | Yeo | 181/229 |

*Primary Examiner*—Charles G. Freay
*Assistant Examiner*—Paul Ratcliffe
*Attorney, Agent, or Firm*—Ostrolenk, Faber, Gerb & Soffen, LLP

[57] ABSTRACT

An improved suction noise muffler mounting apparatus for a hermetic compressor which is capable of more simply mounting a suction noise muffler to a cylinder head, for thus reducing the number of fabrication processes and increasing the productivity of a hermetic compressor, which includes a suction noise muffler head having a protrusion having a predetermined height and formed on the upper surface thereof and integrally engaged to an upper end of the suction noise muffler, and a fixing member provided for mounting the suction noise muffler to a portion of the cylinder head.

2 Claims, 5 Drawing Sheets

SUCTION NOISE MUFFLER MOUNTING APPARATUS FOR HERMETIC COMPRESSOR

This is a division of application Ser. No. 08/740,525, filed Nov. 4, 1996, now U.S. Pat. No. 5,707,215.

BACKGROUND OF THE INVENTION

1. Field of the Invention

The present invention relates to a suction noise muffler mounting apparatus for a hermetic compressor, and in particular to an improved suction noise muffler mounting apparatus for a hermetic compressor which is capable of more simply mounting a suction noise muffler to a cylinder head, for thus reducing the number of fabrication processes and increasing the productivity of a hermetic compressor.

2. Description of the Conventional Art

FIG. 1 is a perspective view illustrating the construction of a conventional suction noise muffler mounting apparatus for a hermetic compressor.

As shown therein, a cylinder head 10 including a head body 11 includes a hole 12 formed in the upper portion of the head body 11, with the hole 12 vertically passing through the upper surface of the head body 11. In addition, a support section 13 having a predetermined height is formed at the periphery of the hole 12.

In addition, a suction noise muffler 20 is mounted to a portion of the cylinder head 10 so as to reduce the noise generated in the compressor. An insertion section 22 is downwardly extended from the bottom of the suction noise muffler body 21 of the suction noise muffler 20 and is inserted into the hole 12 of the cylinder head 10. Here, the insertion section 22 is tightly inserted into the hole 12 of the cylinder head 10. A support section 23 is formed between the bottom of the suction noise muffler body 21 and the insertion section 22.

When mounting the suction noise muffler 20 to the cylinder head 30, an elastic band 30 having a predetermined elastic force is used.

The elastic band 30 includes holes 31 formed at both ends thereof with respect to a pressing section 32 formed in an intermediate portion of the elastic band 30. In addition, in FIG. 1, reference numeral 33 denotes screws. The screws 33 are inserted into the holes 31 of the elastic band 30.

The assembling order of the conventional suction noise muffler mounting apparatus for a hermetic compressor will now be explained with reference to the accompanying drawings.

First, the insertion section 22 is inserted into the hole 12 formed in the upper portion of the cylinder head body 11 of the cylinder head 10. Thereafter, the pressing section 32 of the elastic band 30 is pushed toward the support section 23 of the suction noise muffler 20. The two screws 33 are inserted into the holes 31 of the elastic band 30, and then the elastic band 30 is fixed to the support section 13 of the cylinder head 10 by tightening the screws 33, so that the suction noise muffler 20 is mounted to the cylinder head 10.

However, the conventional suction noise muffler mounting apparatus for a hermetic compressor has the following disadvantages.

First, in a state that the insertion section 22 of the suction noise muffler 20 is inserted into the hole 12 of the cylinder head 10, since the pressing section of the elastic band 30 is pushed toward the support section 23 of the suction noise muffler 20, and the suction noise muffler 20 is fixed to the cylinder head 10 by using the screws 33, the screws 33 may be escaped from the cylinder head 10 due to the repeated chattering of the cylinder head 10 during the operation of the compressor, so that the suction noise muffler 20 is easily separated from the hole 12 of the cylinder head body 11.

Second, since the suction noise muffler 20 is mounted to the cylinder head 10 by using a plurality of screws 33, the engaging force between the suction noise muffler 20 and the cylinder head 10 may become weak.

Third, since the elastic band 30 and the screws 33 are additionally used in order to mount the suction noise muffler 20 to the cylinder head 10, the number of parts is disadvantageously increased, for thus increasing the cost of the hermetic compressor.

Fourth, since the number of parts is increased, the assembly process is increased thereby, for thus decreasing the productivity of the hermetic compressor.

SUMMARY OF THE INVENTION

Accordingly, it is an object of the present invention to provide a suction noise muffler mounting apparatus for a hermetic compressor which overcomes the problems encountered in the conventional suction noise muffler mounting apparatus for a hermetic compressor.

It is another object of the present invention to provide an improved suction noise muffler mounting apparatus for a hermetic compressor which is capable of more simply mounting a suction noise muffler to a cylinder head, for thus reducing the number of fabrication processes and increasing the productivity of a hermetic compressor.

To achieve the above objects, in accordance with a first embodiment of the present invention, there is provided a suction noise muffler mounting apparatus for a hermetic compressor which includes a suction noise muffler head having a protrusion having a predetermined height and formed on the upper surface thereof and integrally engaged to an upper end of the suction noise muffler, and a fixing member provided for mounting the suction noise muffler to a portion of the cylinder head, with said fixing member including a circular section having a bolt receiving hole into which a bolt is inserted, and a pressing section extended from the circular section and having a hole into which the protrusion of the suction noise muffler head is inserted for pressing the upper surface of the suction noise muffler head.

To achieve the above objects, in accordance with a second embodiment of the present invention, there is provided a suction noise muffler mounting apparatus for a hermetic compressor which includes a fixing bolt mounted on the upper portion of the cylinder head, with said fixing bolt including an upper head portion, a lower head portion spaced apart from the upper head portion, a groove section formed between the upper head portion and the lower head portion and having a predetermined diameter smaller than those of the upper head portion and the lower head portion, and a flange section formed in a lower portion of the lower head, and a fixing member including a fixing member engaging section engaged to a cylinder head engaging portion formed in a side surface of the cylinder head, a pressing section formed in an intermediate portion of the fixing member and circularly protruded for pressing the upper portion of the cylinder head, and a fixing member connection section formed at a lower end of the fixing member and having a hole into which the fixing bolt is inserted.

To achieve the above objects, in accordance with a third embodiment of the present invention, there is provided a suction noise muffler mounting apparatus for a hermetic compressor which includes a suction noise muffler head having an upper groove and lower groove formed in one side surface of the suction noise muffler head, and a fixing member for pressing the suction noise muffler head.

Additional advantages, objects and features of the invention will become more apparent from the description which follows.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIGS. 2A through 2D are views illustrating a suction noise muffler mounting apparatus for a hermetic compressor according to a first embodiment of the present invention, of which:

FIG. 2A is a front view illustrating a state that a suction noise muffler mounting apparatus for a hermetic compressor is mounted to a cylinder head;

FIG. 2B is a plan view illustrating the construction of a suction noise muffler for a hermetic compressor;

FIG. 2C is a side view partially illustrating the suction noise muffler for a hermetic compressor; and FIG. 2D is a plan view illustrating the construction of a fixing member for a suction noise muffler mounting apparatus of a hermetic compressor;

FIGS. 3A through 3C are views illustrating the construction of a suction noise muffler mounting apparatus for a hermetic compressor according to a second embodiment of the present invention, of which:

FIG. 3A is a front view illustrating a state that a suction noise muffler for a hermetic compressor is mounted to a cylinder head;

FIG. 3B is a side view illustrating a state that a suction noise muffler for a hermetic compressor is mounted to a cylinder head; and FIG. 3C is a front view illustrating a fixing bolt disposed in a cylinder head;

FIGS. 4A through 4C are views illustrating the construction of a suction noise muffler mounting apparatus for a hermetic compressor according to a third embodiment of the present invention, of which:

FIG. 4A is a front view illustrating a state that a suction noise muffler for a hermetic compressor is mounted to a cylinder head;

FIG. 4B is a perspective view illustrating a suction noise muffler head for a suction noise muffler; and FIG. 4C is a perspective view illustrating a fixing member for a suction noise muffler mounting apparatus for mounting a suction noise muffler for a hermetic compressor to a cylinder head.

DETAILED DESCRIPTION OF THE INVENTION

Figure 1:
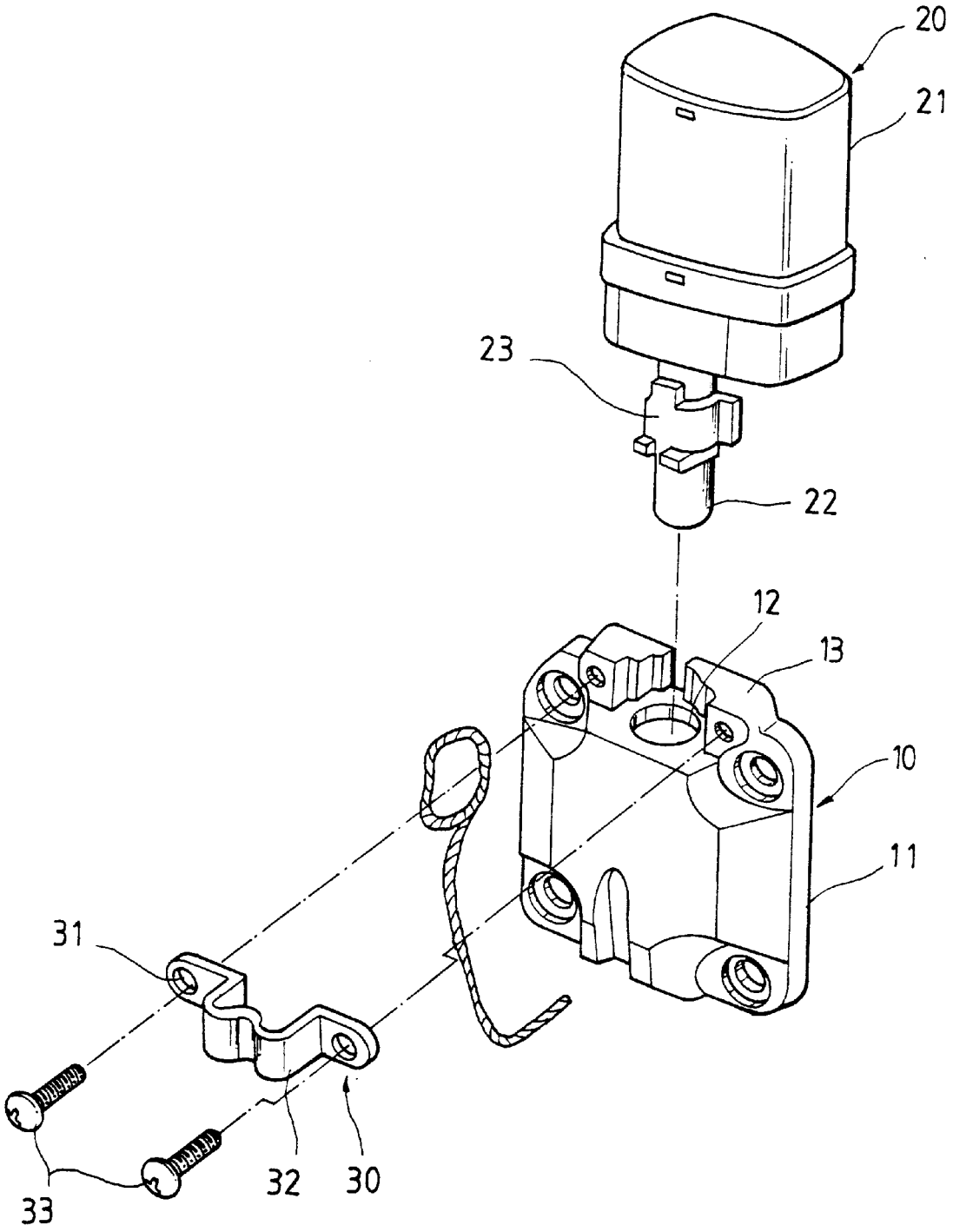
FIG. 1 CONVENTIONAL ART
FIG. 1 is a perspective view illustrating the construction of a conventional suction noise muffler mounting apparatus for a hermetic compressor.
Figure 2A:
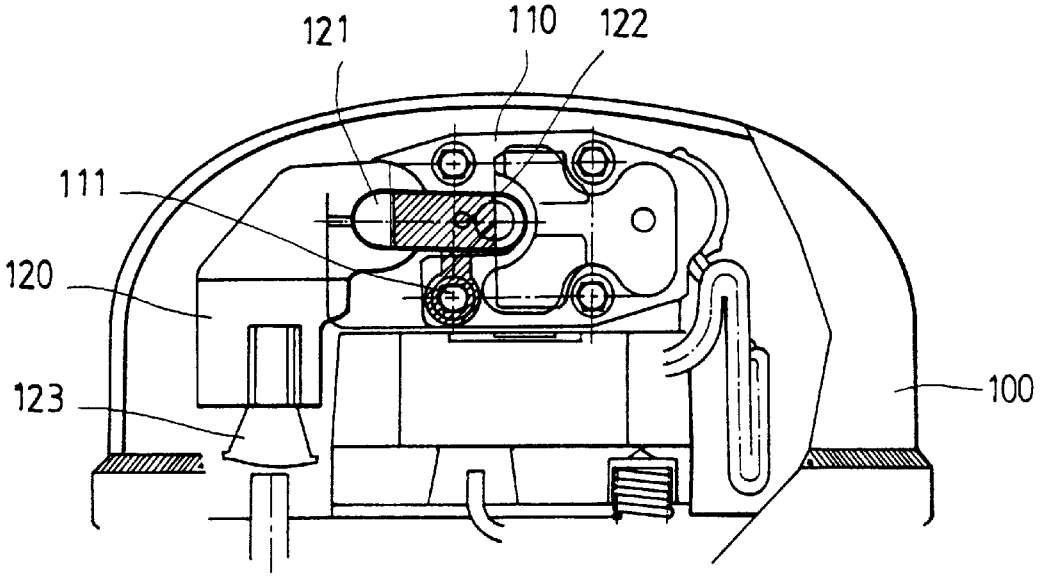
Figure 2B:
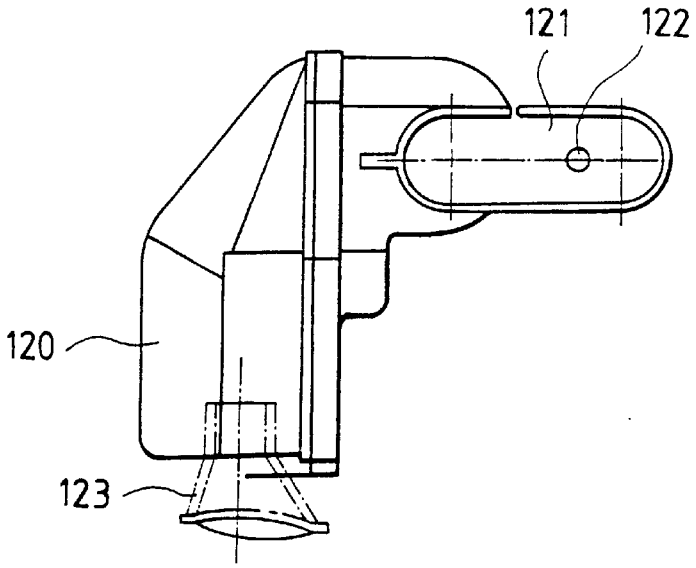
Figure 2C:
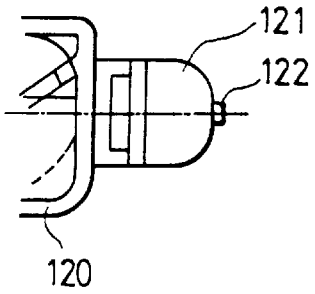
Figure 2D:
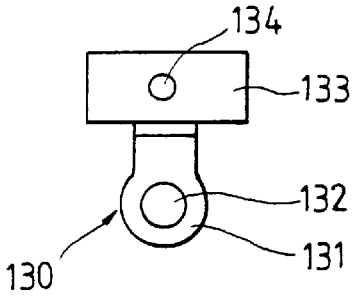

FIGS. 2A through 2D are views illustrating a suction noise muffler mounting apparatus for a hermetic compressor according to a first embodiment of the present invention.

As shown therein, a cylinder body 100 includes a cylinder head 110. The cylinder head 110 is mounted to a portion of the cylinder body 100 by using four bolts 111. The cylinder head 110 includes a suction noise muffler 120 mounted to a portion thereof so as to reduce noise generated in the interior of the hermetic compressor.

In the drawings, reference numeral 123 denotes a suction portion of the suction noise muffler 120.

A suction noise muffler head 121 having a predetermined length is attached to the upper portion of the suction noise muffler 120. The suction noise muffler head 121 includes a protrusion 122 formed on the upper surface of the suction noise muffler head 121.

In order to prevent the chattering or dislocation of the suction noise muffler 120 after the suction noise muffler 120 is mounted to the cylinder head 110, a fixing member 130 is used. In other words, the fixing member 130 is directed to preventing the suction noise muffler 120 from being dislocated or separated from the cylinder head 110 due to the vibrations of the suction noise muffler 120.

The fixing member 130 includes a circular section 131 having a bolt receiving hole 132 having a predetermined diameter, and a rectangular pressing section 133 having a hole 134 formed in the center portion thereof.

In more detail, one of four bolts 111 mounted on the upper surface of the cylinder head 110 is inserted into the bolt receiving hole 132 formed in the circular section 131 of the fixing member 130.

The assembling order of the suction noise muffler mounting apparatus for a hermetic compressor according to the present invention will now be explained with reference to FIGS. 2A through 2D.

First, one of four bolts 111 mounted on the upper surface of the cylinder head 110 is untightened, and is inserted into the bolt receiving hole 132 formed in the circular section 131 of the fixing member 130. Thereafter, the protrusion 122 formed on the upper surface of the suction noise muffler head 121 of the suction noise muffler 120 is inserted into the hole 134 formed in the upper surface of the pressing section 133 of the fixing member 130. Next, the bolt 111 inserted into the bolt receiving hole 132 of the fixing member 13 is tightened. Therefore, the pressing section 133 of the fixing member 130 presses the upper portion of the suction noise muffler head 121, so that the suction noise muffler 120 is more tightly and stably mounted on the cylinder head 110.

Next, a suction noise muffler mounting apparatus for a hermetic compressor according to a second embodiment of the present invention will now be explained with reference to FIGS. 3A through 3D.

Figure 3A:
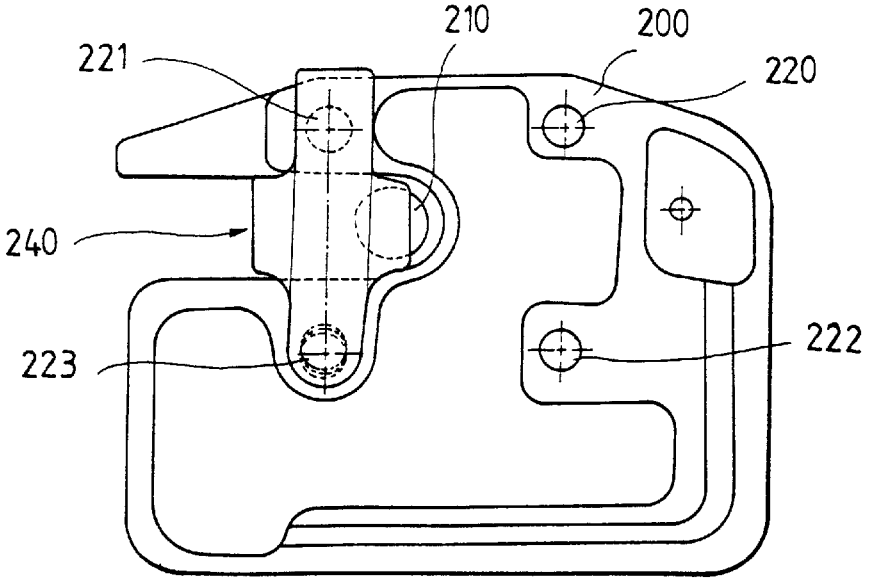

FIG. 3A is a front view illustrating a state that a suction noise muffler for a hermetic compressor is mounted to a cylinder head. As shown therein, a suction noise muffler (not shown) having a suction noise muffler head 210 is mounted to a portion of a cylinder head 200, with the upper portion of the suction noise muffler head 210 being circular. The suction noise muffler head 210 is protruded by a predetermined height. In addition, three bolts 220, 221, and 222 and a fixing bolt 223 are mounted on the side surface of the cylinder head 200.

Figure 3B:
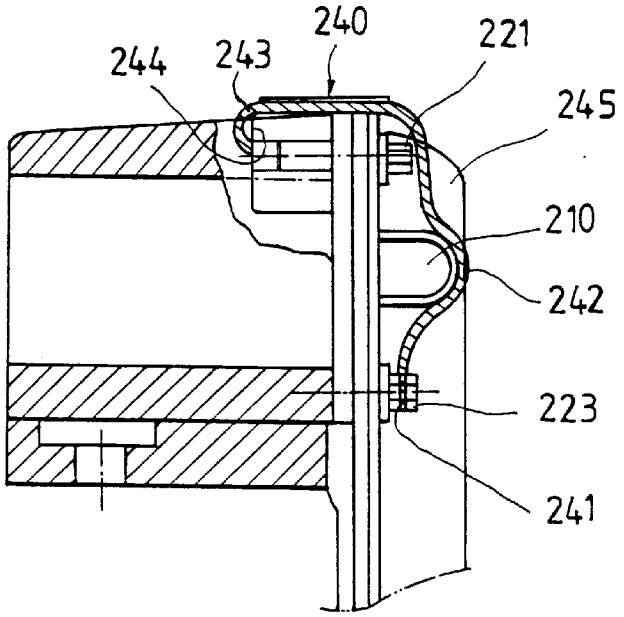
Figure 3C:
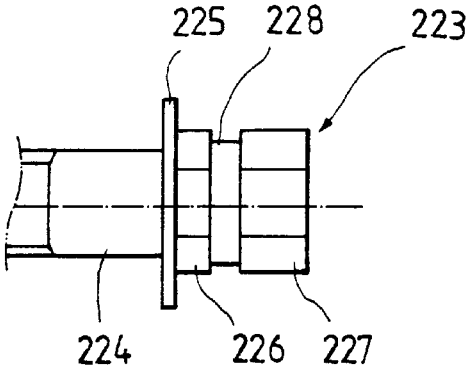

As shown in FIG. 3C, the fixing bolt 223 includes a bolt body 224, a flange section 225 formed near the bolt body 224 and having a greater diameter than the bolt body 224, a lower head 226, and an upper head 227. A groove section 228 having a smaller diameter than the lower head 226 and the upper head 227 is formed between the lower head 226 and the upper head 227.

In addition, a fixing member 240 is used for pressing the upper portion of the suction noise muffler head 210. As shown in FIG. 3B, the fixing member 240 includes a fixing member connection portion 241 formed in the lower end of the fixing member 240. A hole (not shown) is formed in the fixing member connection portion 241 of the fixing member 240 in order for the groove section 228 of the fixing bolt 223 to be inserted into the hole formed in the fixing member connection portion 241. In addition, a semicircular-shaped pressing section 242 is formed in the intermediate portion of the fixing member 240. The pressing section 242 serves to press the upper portion of the suction noise muffler head 210. The fixing member 240 includes a fixing member engaging section 243 formed in the upper end of the fixing member 240. The fixing member engaging section 243 is engaged to a cylinder head engaging section 244 formed in a side surface of the cylinder head 200. In the drawings, reference 245 denotes a head cover for covering the upper portion of the cylinder head 200.

The assembling order and effects of the suction noise muffler mounting apparatus for a hermetic compressor according to the second embodiment of the present invention will now be explained with reference to FIGS. 3A through 3C.

First, the groove section 228 formed in the fixing bolt 223 of the cylinder head 200 is inserted into the hole (not shown) formed in the fixing member connection portion 241 of the fixing member 240.

The fixing member engaging section 243 of the fixing member 240 is pushed and is engaged to the cylinder head engaging section 244.

Thereafter, the bolt 221 is completely covered by the fixing member 240, and the pressing section 242 of the fixing member 240 presses the upper portion of the suction noise muffler head 210.

Therefore, it is possible to more easily and stably mount the suction noise muffler to the cylinder head 200 in cooperation with the fixing member 240.

Figure 4A:
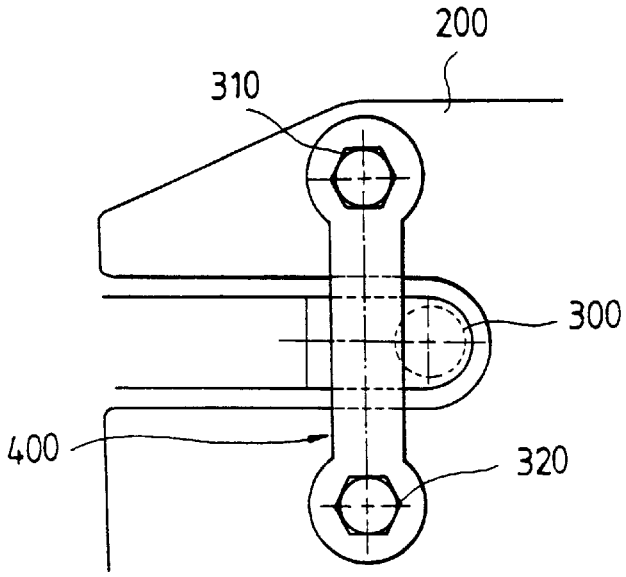
Figure 4B:
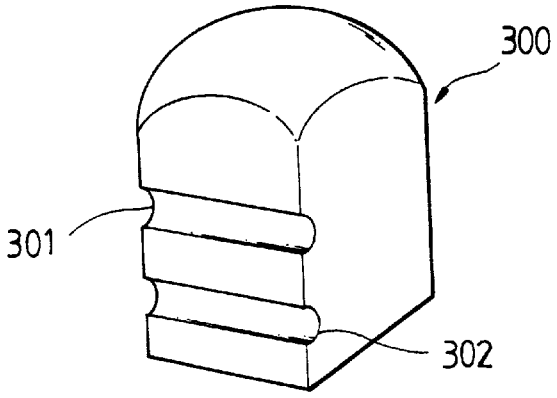
Figure 4C:
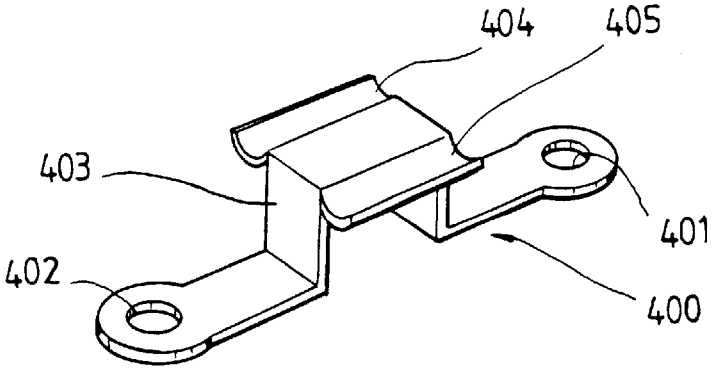

Next, a suction noise muffler mounting apparatus for a hermetic compressor according to a third embodiment of the present invention will now be explained with reference to FIGS. 4A through 4C.

First, the suction noise muffler head 300 includes a parallel upper groove 301 and lower groove 302 each having a predetermined width and formed on one side surface thereof. A fixing member 400 is shown in FIG. 4C. As shown therein, the fixing member 400 includes symmetrical upper and lower bolt holes 401 and 402. A protruded section 403 is formed between the upper and lower bolt holes 401 and 402. The protruded section 403 includes an upper groove insertion section 404 and a lower groove insertion section 405 integrally formed at both sides of the protruded section 403. Here, when mounting the fixing member 400 to the suction noise muffler head 300, the upper groove insertion section 404 of the fixing member 400 is inserted into the upper groove 301 of the suction noise muffler head 300, and the lower groove insertion section 405 of the fixing member 400 is inserted into the lower groove 302 of the suction noise muffler head 300.

In the drawings, reference numeral 310 denotes an upper bolt which is inserted into the upper bolt hole 401 of the fixing member 400, and reference numeral 320 denotes a lower bolt which is inserted into the lower bolt hole 402 of the fixing member 400.

Next, the assembling order of the suction noise muffler mounting apparatus for a hermetic compressor according to the third embodiment of the present invention will now be explained with reference to FIGS. 4A through 4C.

First, the fixing member 400 is placed above the suction noise muffler head 300. The upper bolt 310 is inserted into the upper bolt hole 401, and the lower bolt 320 is inserted into the lower bolt hole 402, for thus mounting the fixing member 400 to the cylinder head 200. Thereafter, the upper groove insertion section 404 and the lower groove insertion section 405 formed in the protruded section 403 of the fixing member 400 are inserted into the upper groove 301 and the lower groove 302, respectively. Therefore, the fixing member 400 is more stably mounted to the suction noise muffler head 300.

As described above, the suction noise muffler mounting apparatus for a hermetic compressor according to the present invention has the following advantages.

First, it is possible to more easily mount the suction noise muffler to the cylinder head by using the suction noise muffler mounting apparatus according to the present invention.

Second, it is possible to effectively prevent the suction noise muffler from being separated from the cylinder head, which separation is due to a scattering (vibrations) of the cylinder during the operation of the compressor.

Third, it is possible to reduce the number of fabrication processes of the hermetic compressor, and to more easily mount the suction noise muffler to the cylinder head, for thus increasing the productivity of the hermetic compressor.

Fourth, it is possible to significantly reduce the fabrication cost of the hermetic compressor.

Although the preferred embodiments of the present invention have been disclosed for illustrative purposes, those skilled in the art will appreciate that various modifications, additions and substitutions are possible, without departing from the scope and spirit of the invention as recited in the accompanying claims.

What is claimed is:

1. In a suction noise muffler mounting apparatus for hermetic compressor having a cylinder head, an upper bolt and a lower bolt mounted on the cylinder head, and a suction noise muffler head of a suction noise muffler for reducing noise generated in a compressor, a suction noise muffler mounting apparatus for mounting the suction noise muffler to a portion of the cylinder head, comprising:

a suction noise muffler head having an upper groove and lower groove formed in one side surface of the suction noise muffler head; and a fixing member for pressing the suction noise muffler head.

2. The apparatus of claim 1, wherein said fixing member includes:

a spaced-apart upper bolt hole and lower bolt hole formed at both ends of the fixing member;

a protruded section formed between the upper bolt hole and lower bolt hole; and an upper hole insertion section and lower groove insertion section integrally extended from both sides of the protruded section, wherein the upper groove insertion section is inserted to the upper groove of the suction noise muffler head, and the lower groove insertion section is inserted to the lower groove of the same.

* * * * *